US010569306B2

(12) United States Patent
Tabrizi

(10) Patent No.: US 10,569,306 B2
(45) Date of Patent: Feb. 25, 2020

(54) CONSTRUCTION SITE TOOL CLEANING SINK SYSTEM

(71) Applicant: Behnam Tabrizi, San Diego, CA (US)

(72) Inventor: Behnam Tabrizi, San Diego, CA (US)

( * ) Notice: Subject to any disclaimer, the term of this patent is extended or adjusted under 35 U.S.C. 154(b) by 174 days.

(21) Appl. No.: 15/493,098

(22) Filed: Apr. 20, 2017

(65) Prior Publication Data

US 2018/0304313 A1 Oct. 25, 2018

(51) Int. Cl.
*B08B 3/00* (2006.01)

(52) U.S. Cl.
CPC ..... *B08B 3/006* (2013.01)

(58) Field of Classification Search
CPC ..... B08B 3/006
See application file for complete search history.

(56) References Cited

U.S. PATENT DOCUMENTS 4,052,227 A * 10/1977 Delo ..... B08B 3/006 134/111
4,128,478 A * 12/1978 Metzger ..... B08B 3/006 134/111
4,317,720 A * 3/1982 Hawk ..... A47L 15/14 210/114
5,915,398 A * 6/1999 Chen ..... B08B 3/006 134/104.1
6,609,258 B1 * 8/2003 Clements ..... B08B 3/006 206/576
9,067,616 B1 * 6/2015 Tabrizi ..... B62B 1/18
2001/0009046 A1 * 7/2001 Cardemon ..... B08B 3/006 15/1

* cited by examiner

*Primary Examiner* — Spencer E Bell
(74) *Attorney, Agent, or Firm* — John R. Ross, III; John R. Ross

(57) ABSTRACT

A construction site tool cleaning system. A construction sink is supported by support legs. A drip pant is preferably positioned under the support legs and under the construction sink. Construction sink stabilizers are connected to the support legs and support the construction sink. A construction sink tool support screen covers the top of the construction sink. An elevated pump section is inside the construction sink and is at a higher level than the bottom of the construction sink. A water pump is positioned inside the elevated pump section. A filter screen and filter are positioned on top of the elevated pump section and surround the water pump. A flexible hose is connected to the water pump and a nozzle is connected to the flexible hose.

9 Claims, 12 Drawing Sheets

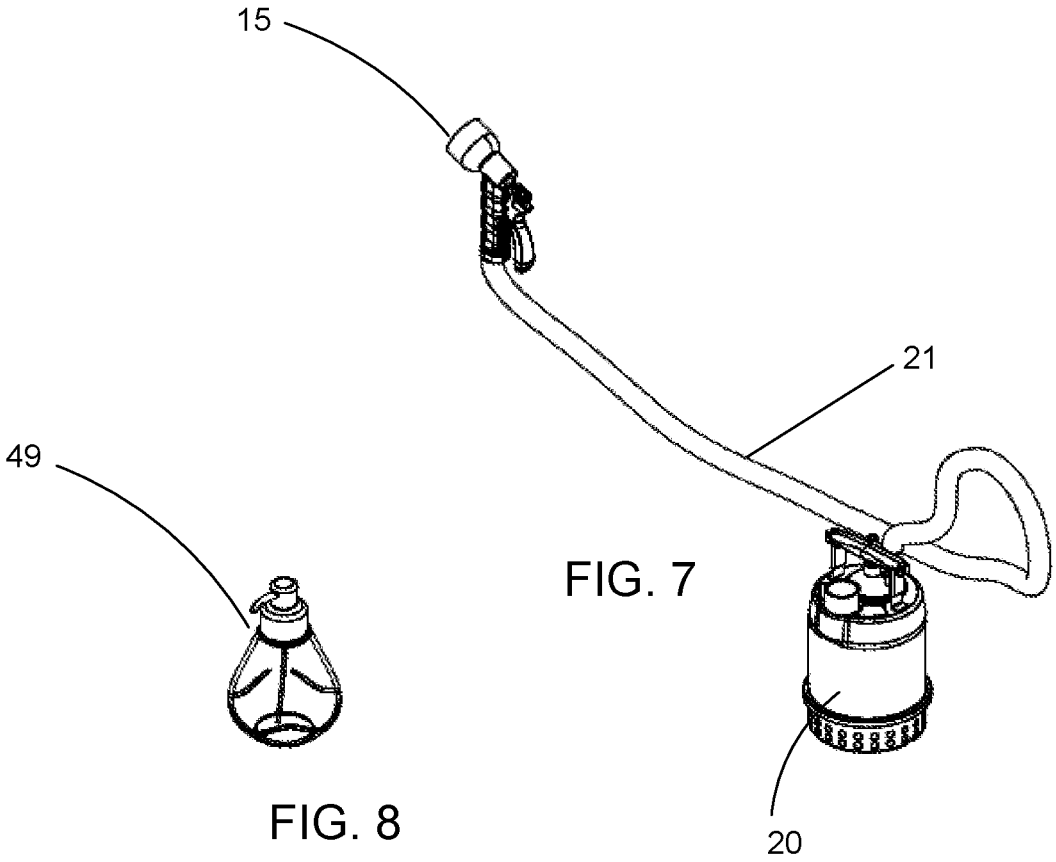
FIG. 7
FIG. 8
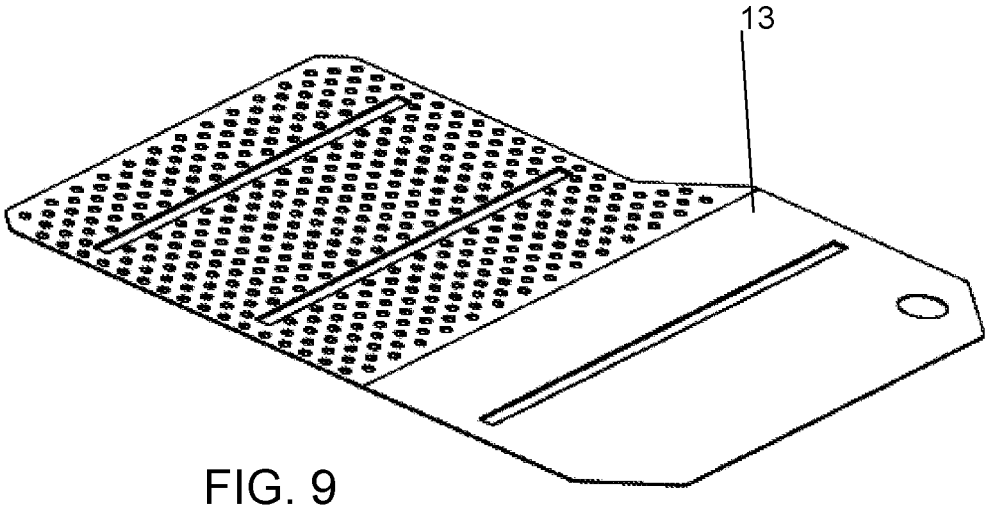
FIG. 9

CONSTRUCTION SITE TOOL CLEANING SINK SYSTEM

The present invention relates to sinks, and in particular, to sinks for used for cleaning tools at a construction site.

BACKGROUND OF THE INVENTION

Many construction sites are at remote locations and require workers to work with tools and then clean those tools at the remote location. It is unacceptable to hose down a tool and let the runoff water collect on the ground or go down to the storm drain system. This is unsafe for the workers who are working on the project, unsafe for people who will eventually be living or working at the site, and is bad for the environment.

Currently sometimes workers will bring a wheelbarrow to the construction site and clean their tools within the body of the wheelbarrow. However, fluid removal from the tray of a wheelbarrow can be a problem for workers. Often the fluid is contaminated and it is not acceptable just to dump the fluid on the ground. Instead workers are forced to scoop the fluid out with a bucket or roll the wheelbarrow to an appropriate dump area where the contaminated fluid can be dumped. Both of these methods are cumbersome and time consuming and result in decreased productivity for the worker.

SlurrySep™ refers to a proprietary blend of bentonite clay, polymers and pH reducing acids is designed for treatment of concrete slurry. As the bentonite clay hydrates, a strong negative charge is produced, causing a flocculation by suspended particles sticking to the clay surface. SlurrySep™ is utilized to remove high levels of suspended solids from waste waters generated from concrete-related applications. SlurrySep™ is available from slurrysolutions.com.

SlurryDry™ refers to a superabsorbent polymer that will absorb free water from moist concrete and that will allow the product to be placed into a landfill and pass the Paint Filter Liquids Test (PFLT) and the Toxicity Charact Procedure (TCLP) for heavy metals. SlurryDry™ is a fast and easy way to solidify heavy concrete slurry sludge for jobsite disposal. SlurryDry™ is also available from slurrysolutions.com.

What is needed is a better system for cleaning tools at a construction site.

BRIEF DESCRIPTION OF THE DRAWINGS

The present invention provides a construction site tool cleaning system. A construction sink is supported by support legs. A drip pan is preferably positioned under the support legs and under the construction sink. Construction sink stabilizers are connected to the support legs and support the construction sink. A construction sink tool support screen covers the top of the construction sink. An elevated pump section is inside the construction sink and is at a higher level than the bottom of the construction sink. A water pump is positioned inside the elevated pump section. A filter screen and filter are positioned on top of the elevated pump section and surround the water pump. A flexible hose is connected to the water pump and a nozzle is connected to the flexible hose.

BRIEF DESCRIPTION OF THE DRAWINGS

Figure 1:
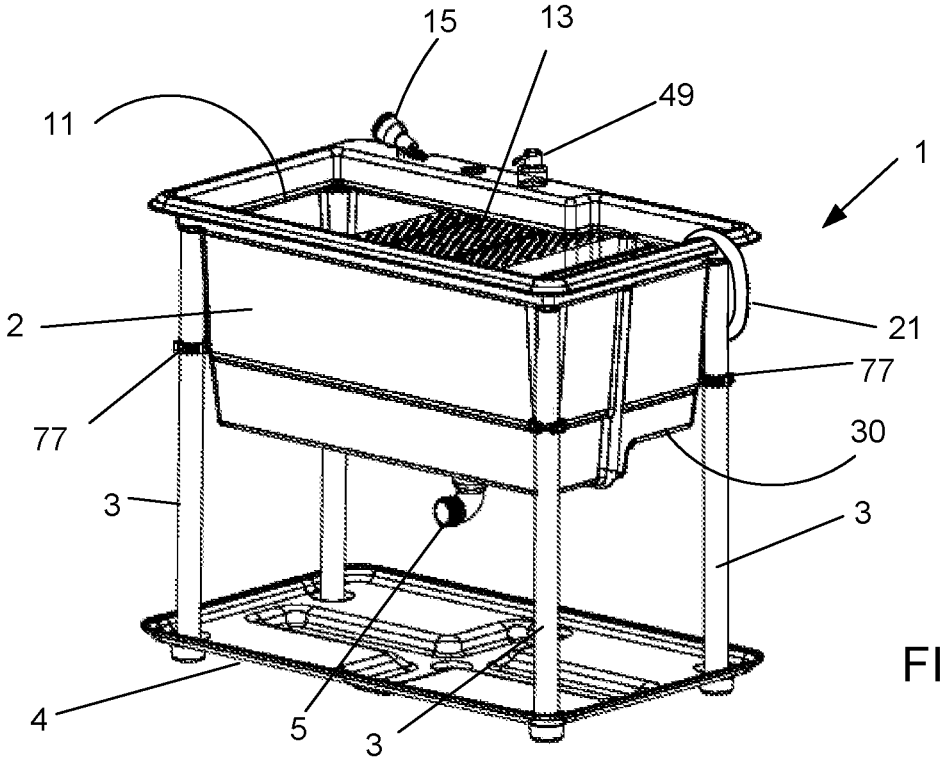
Figure 2:
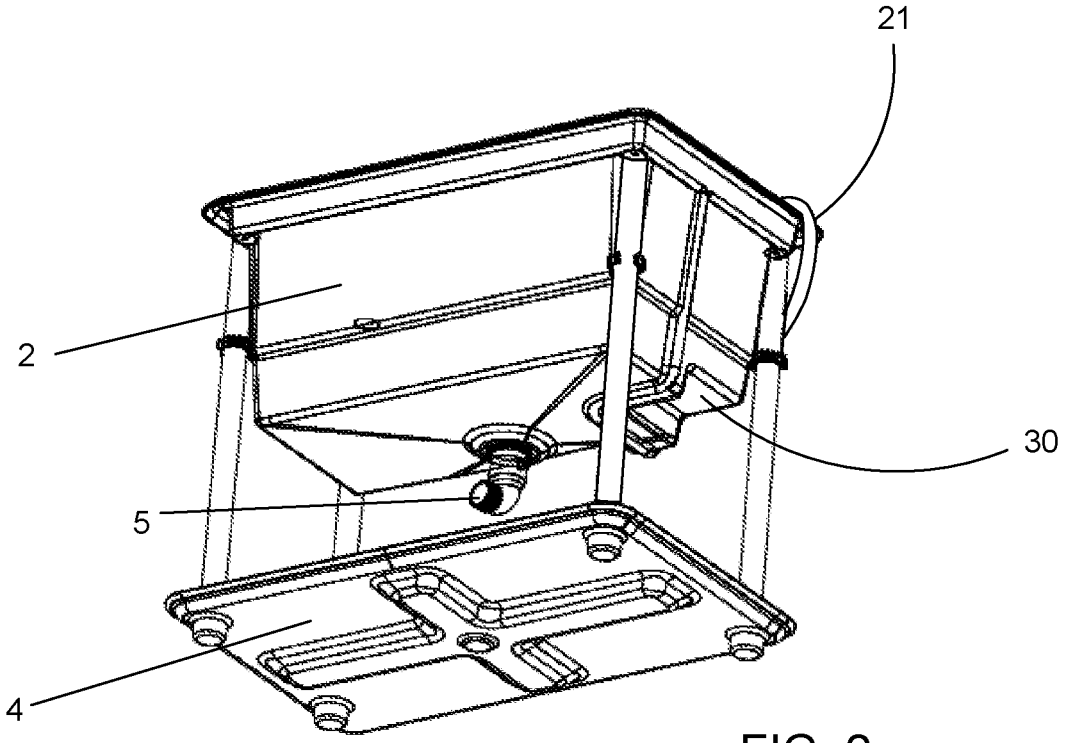

FIGS. 1-2 show perspective views of a preferred embodiment of the present invention.

Figure 3:
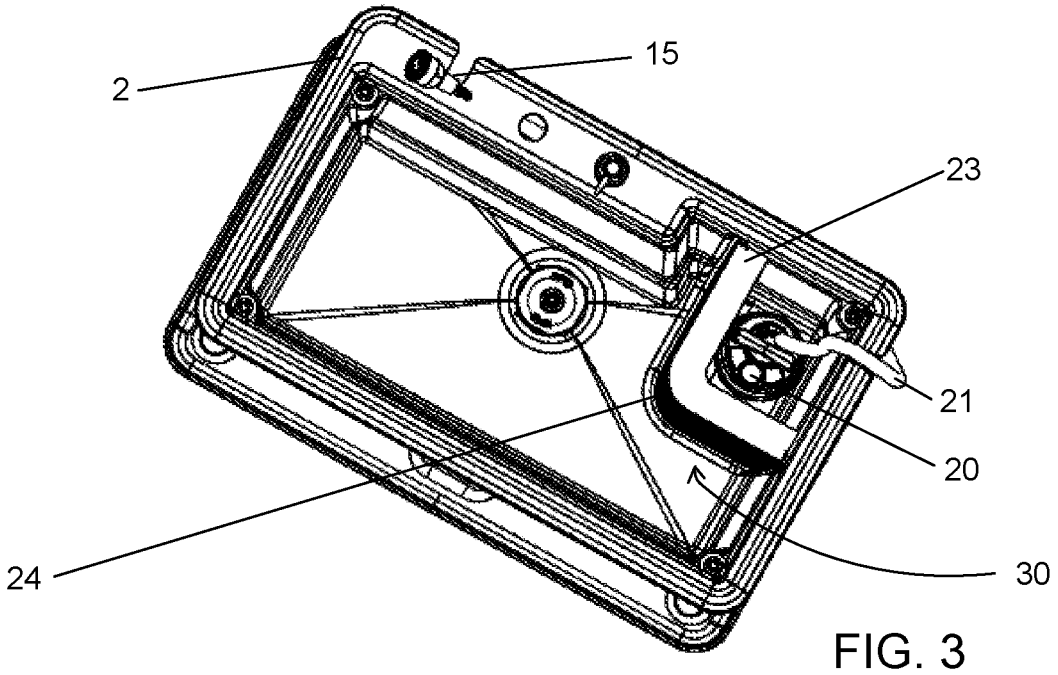
Figure 4:
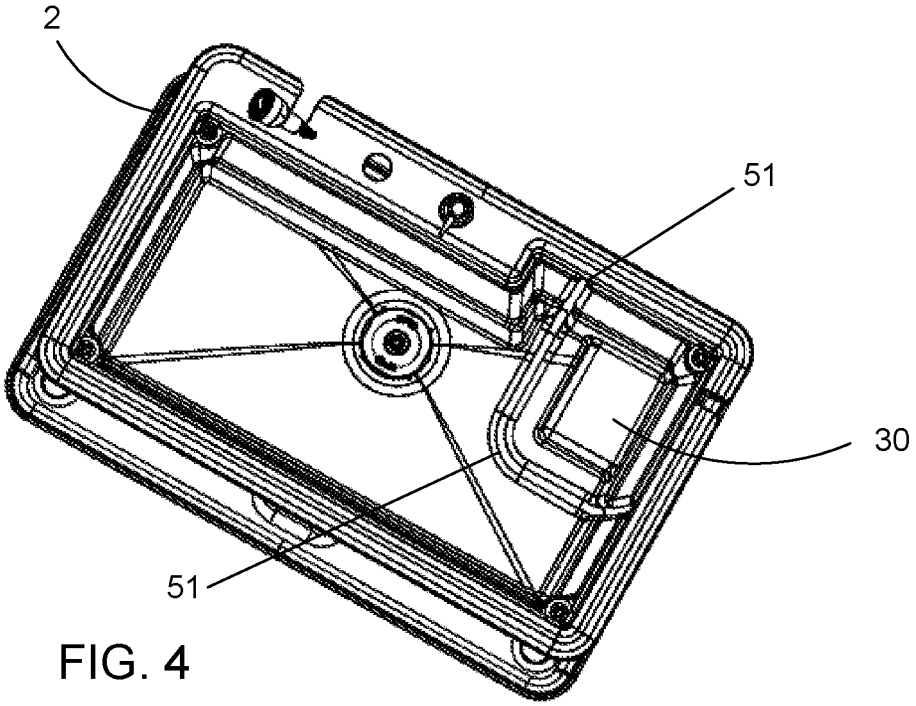

FIGS. 3-4 show a top view of a preferred construction sink.

Figure 5:
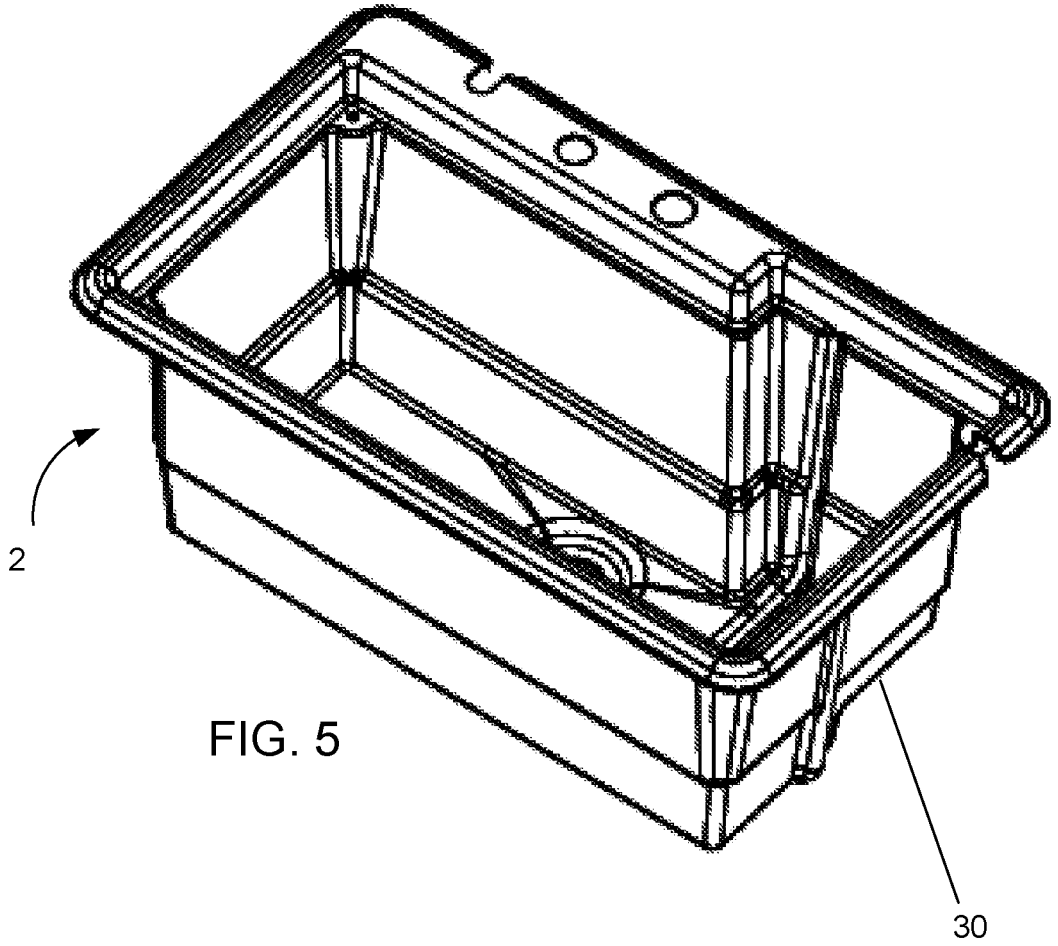

FIG. 5 shows a perspective view of a preferred construction sink.

Figure 6:
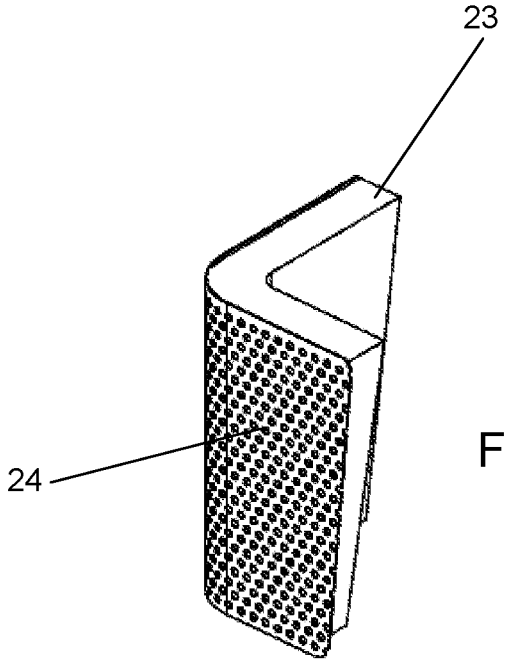

FIG. 6 shows a perspective view of a preferred filter screen and filter.

FIG. 7 shows a view of a pump, flexible hose and nozzle.

FIG. 8 shows a preferred soap dispenser.

FIG. 9 shows a preferred tool support screen.

Figure 10:
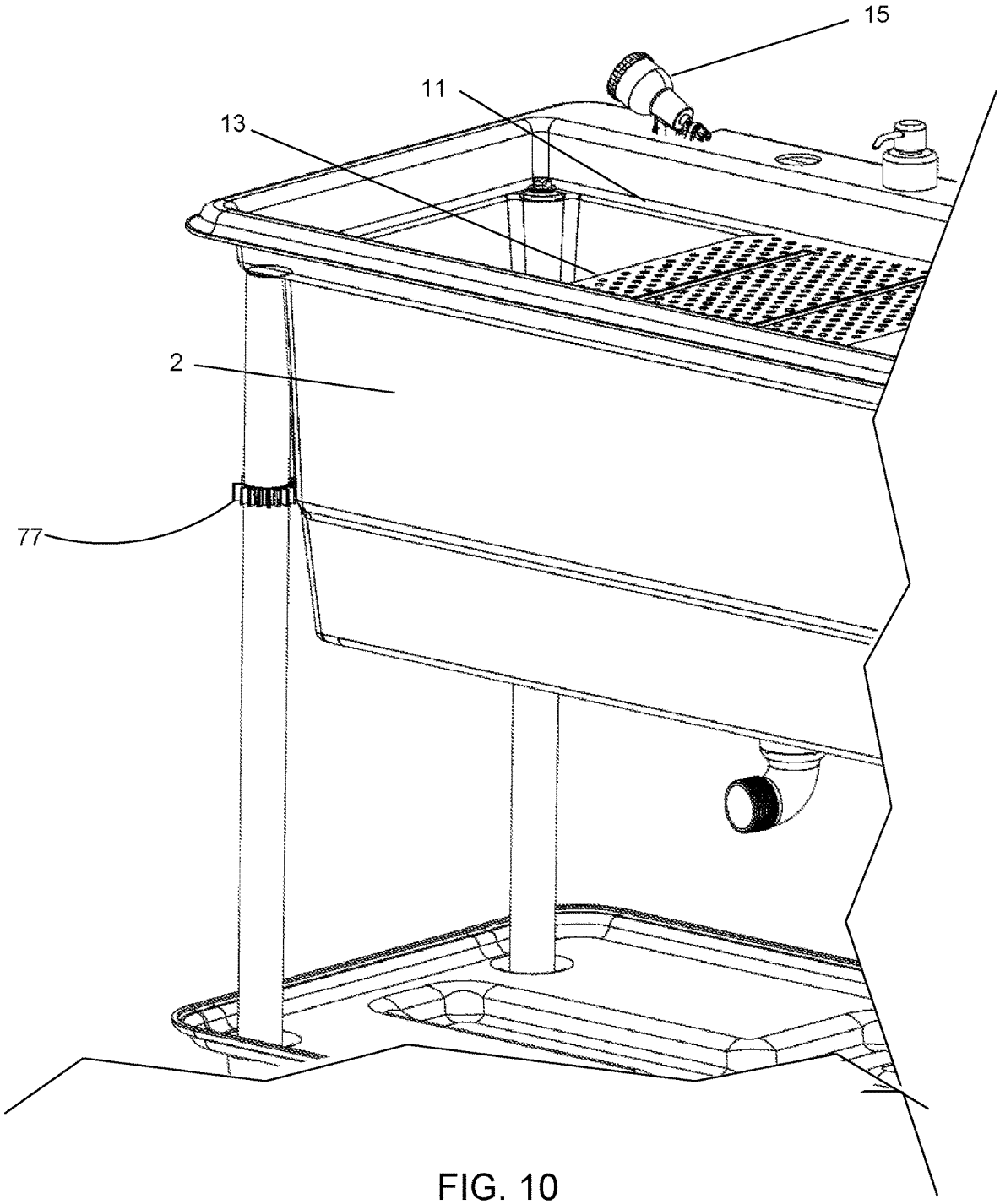

FIG. 10 shows a preferred embodiment of the present invention.

Figure 11:
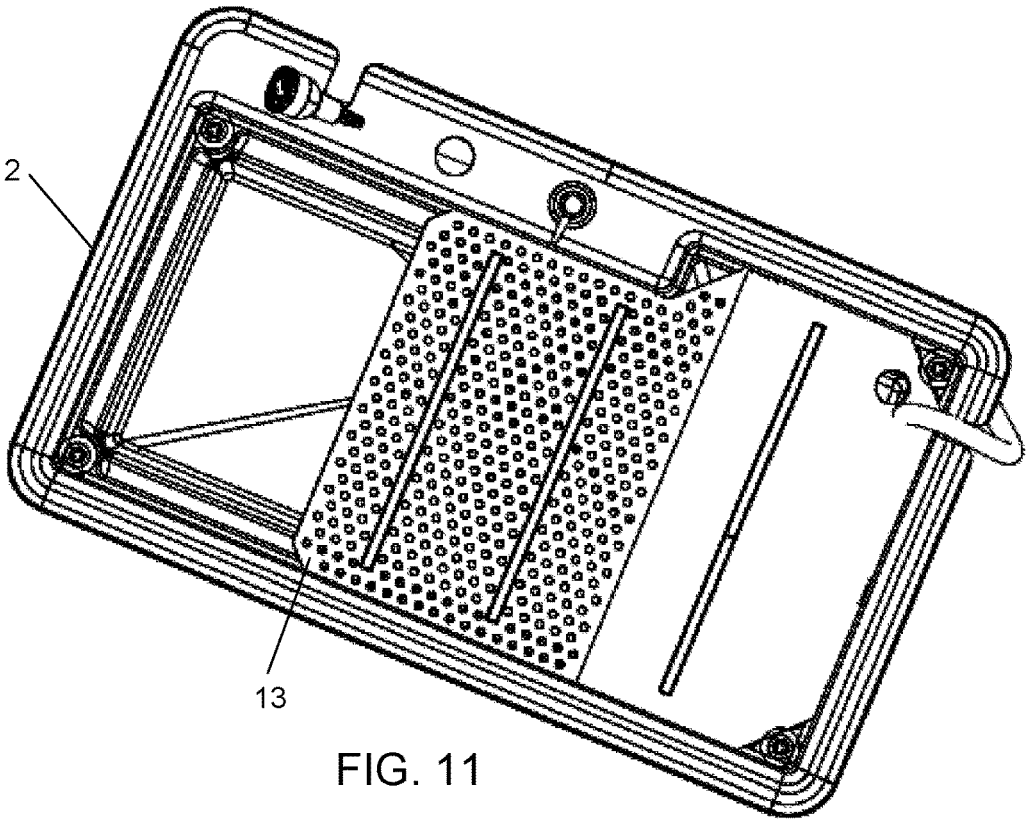

FIG. 11 shows a preferred tool support screen.

Figure 12:
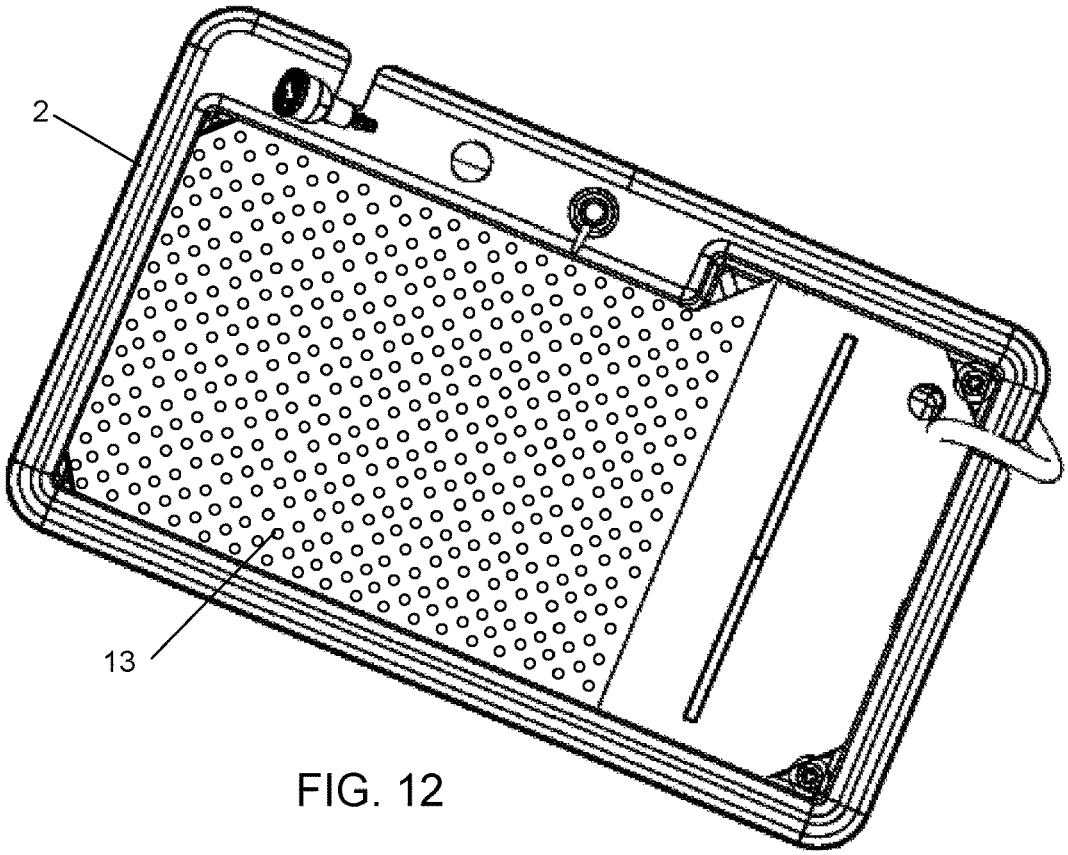

FIG. 12 shows another preferred tool support screen.

Figure 13:
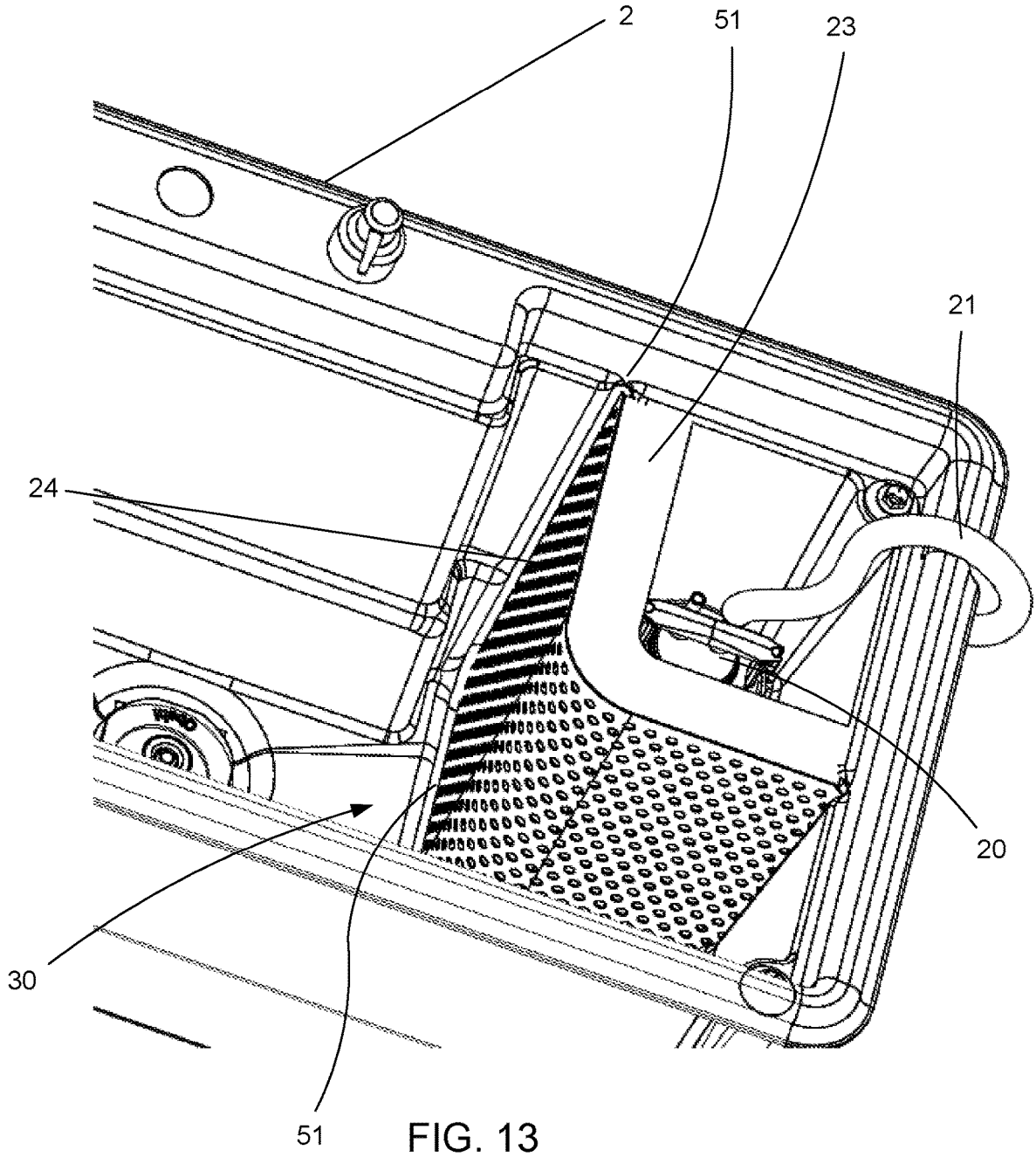

FIG. 13 shows an elevated tool section.

Figure 14:
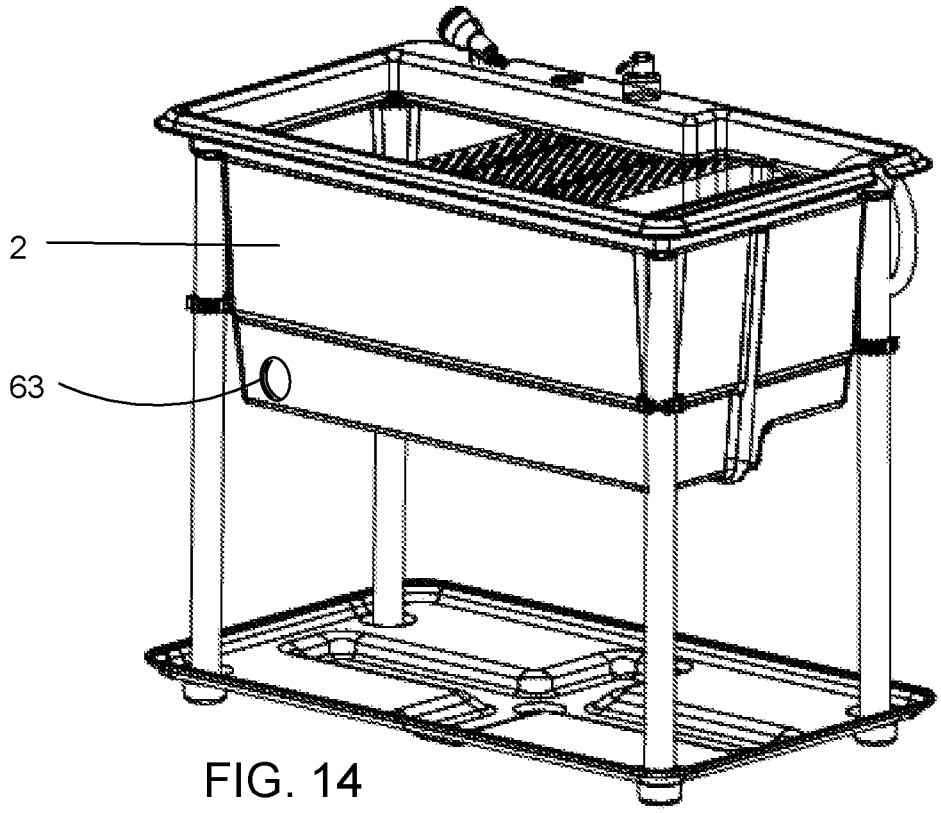
Figure 15:
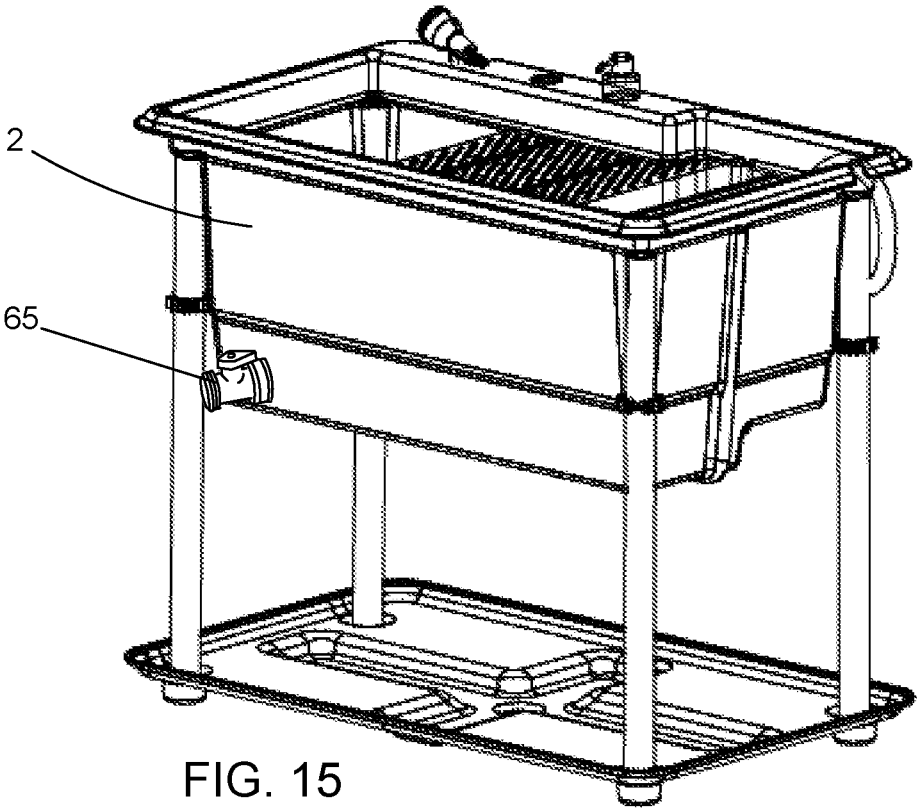

FIGS. 14-15 show another preferred embodiment of the present invention.

Figure 16:
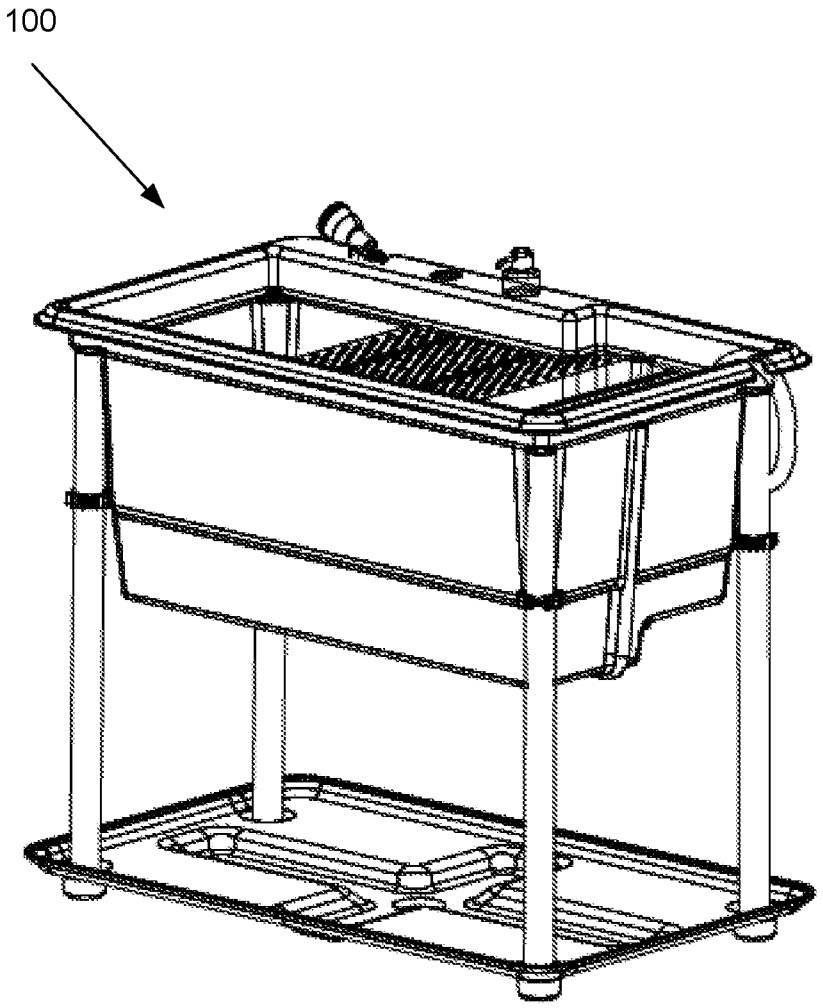

FIG. 16 shows another preferred embodiment of the present invention.

Figure 17:
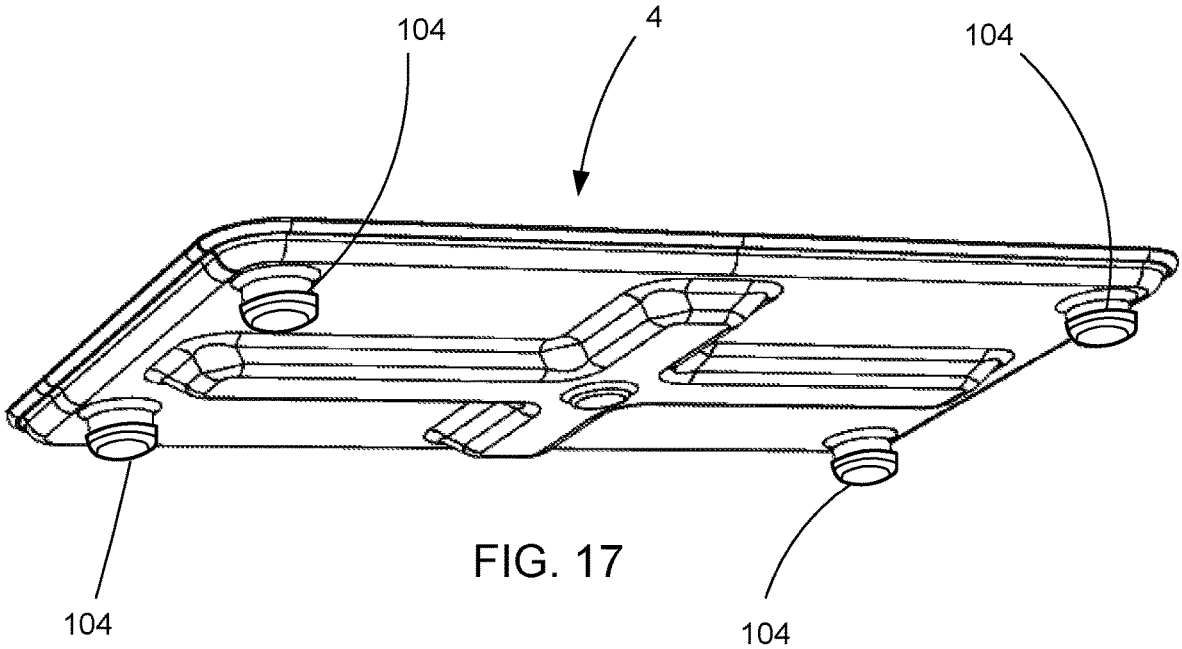

FIG. 17 shows a preferred drip pan.

FIGS. 18-21 show preferred strainers.

Figure 22:
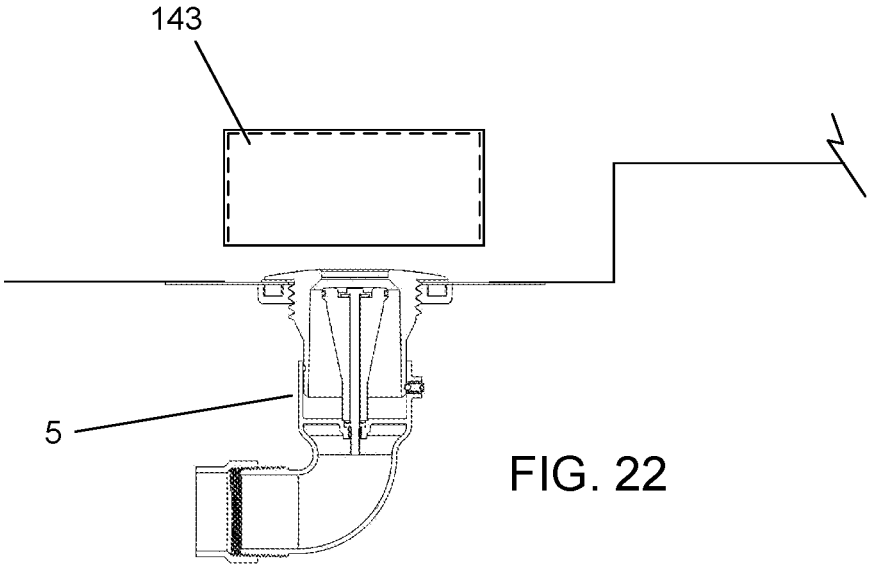
Figure 23:
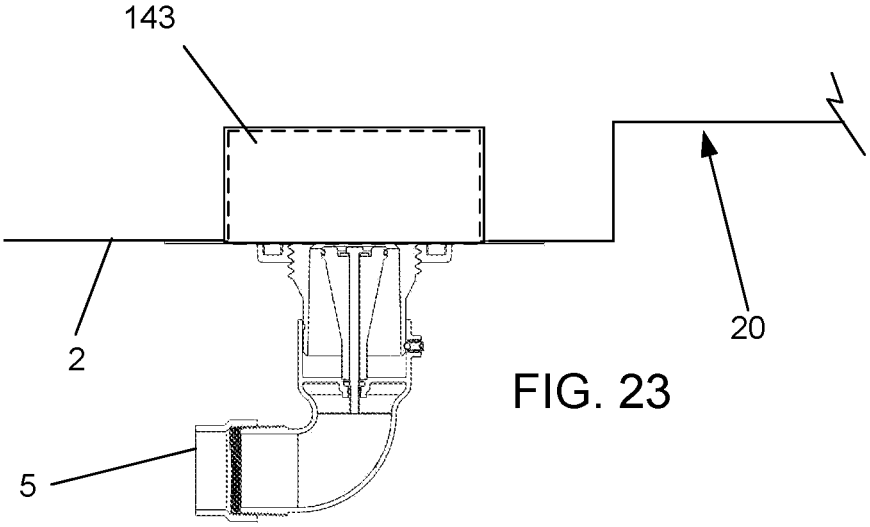

FIGS. 22-23 show the utilization of a preferred strainer.

DETAILED DESCRIPTION OF THE PREFERRED EMBODIMENTS

FIGS. 1 and 2 show a preferred embodiment of the present invention. A worker can utilize the construction sink system 1 to clean his tools while maintaining contaminated water inside sink 2. Common tools that may be cleaned include tools associated with paint, masonry and dry wall construction.

After the work is done at the construction site, the contaminated water inside sink 2 can be disposed of in a proper fashion. To utilize construction sink system 1 the worker first places his tools on top of screen 13 and then uses water nozzle 15 to wash his tools. The contaminated water will fall through screen 13 and collect inside sink 2. The contaminated water is filtered through filter 23 (FIG. 3) so that clean water is pumped back through flexible hose 21 so that it can be used for further cleaning. Flexible hose 21 is connected to water nozzle 15. The worker can utilize soap from soap dispenser 49 to wash his hands and tools. When the worker is finished cleaning his tools, he can open closable drain 5 and drain the contaminated water into an acceptable receptacle or through a drain hose.

In a preferred embodiment before draining water through drain 5, a chemical additive is added to the solution in sink 2. The chemical additive is to remove high levels of suspended solids from concrete slurry generated from the concrete-related applications. The treated solution will then drain easier leaving behind solids. In a preferred embodiment the chemical additive is SlurrySep™ discussed above in the Background section.

Also in a preferred embodiment the moist solids can be further treated by adding a superabsorbent polymer that will absorb free water from the remaining moist concrete. The remaining product can then be easily disposed of in a landfill. In a preferred embodiment the superabsorbent polymer is SlurryDry™ discussed above in the Background section.

Construction sink 1 includes sink 2 supported by four legs 3. Legs 3 are inserted into drip pan 4 as shown. Closable drain 5 is connected to a hole in the bottom of sink 2 and allows a worker to drain the contents out of sink 2. In a preferred embodiment closable drain 5 is identical to drainage system 10 discussed in detail in U.S. Pat. No. 9,067,616, issued to Applicant on Jun. 30, 2015 and incorporated by reference herein. Closable drain 5 is preferable because it allows the worker to open and close the drain from the outside of sink 2 without placing his hands inside sink 2.

Tool support screen 13 rests on ridges 11 of sink 2 (see also FIGS. 9 and 10). A worker can place his tools on top of screen 13 and wash his tools by utilization of water nozzle 15. The dirty water will fall through the holes in screen 13 and collect inside sink 2. In one preferred embodiment screen 13 extends partway across the top of sink 2 (FIG. 11). In another preferred embodiment screen 13 extends the entire way across the top of sink 2 (FIG. 12).

The Pump

In a preferred embodiment of the present invention, sink 2 includes elevated pump support section 30. As best shown in FIGS. 1, 2 and 5 the bottom of elevated pump section 30 is elevated so that it is at a higher level than the bottom of sink 2. Pump 20 rests on the bottom of elevated pump section 30. Pump 20 is surrounded by filter 23 and filter screen 24 (FIGS. 3, 6, and 13). Filter screen 24 fits snuggly into groove 51 of tank 2. Groove 51 functions to hold filter screen 24 and filter 23 firmly in place on top of elevated pump section 30. Flexible hose 21 is connected to pump 20 at one end and to nozzle 15 at its other end (FIG. 7).

Pump 20 is isolated from the rest of sink 2 by virtue of resting on the bottom of elevated pump section 30 and by being surrounded by filter 23 and filter screen 24. Only clean filtered water is contained in elevated pump section 30. It is this clean filtered water that is pumped through hose 21 back to nozzle 15 where it may be used to spray onto tools being cleaned.

One benefit of elevated pump section 30 is that it holds pump 20, filter screen 23 and filter 24 at a level higher than the bottom level of sink 2. By being at a higher level, this equipment is kept separated from most debris and heavy scum that may settle towards the bottom of the sink. This will increase the operable life and functionality of pump 20, filter screen 23 and filter 24.

Leg Mounted Sink Stabilizers

As shown in FIGS. 1 and 2, sink stabilizers 77 are mounted to legs 3 as shown. They are preferably fabricated from a flexible rubbery material and are pressure fit onto legs 3. Sink 2 rests against stabilizers 77. Stabilizers 77 contribute to the sturdiness of sink 2 and prevent sink 2 from wobbling while being utilized. FIG. 10 shows a more detailed view of stabilizer 77 supporting sink 2.

Strainer

Figure 18:
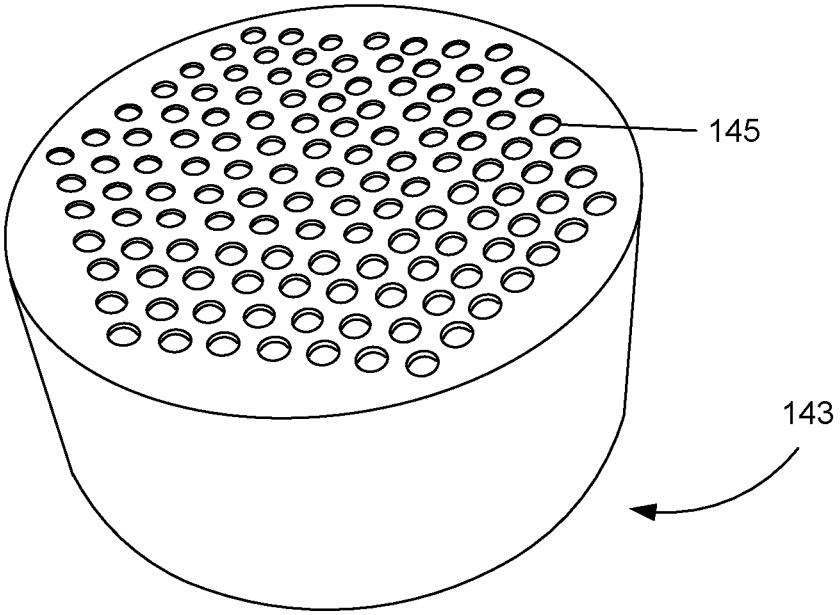
Figure 19:
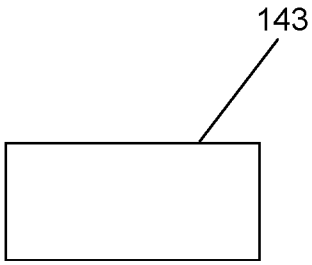
Figure 20:
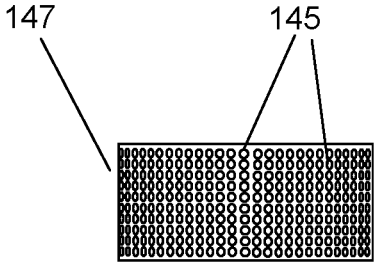
Figure 21:
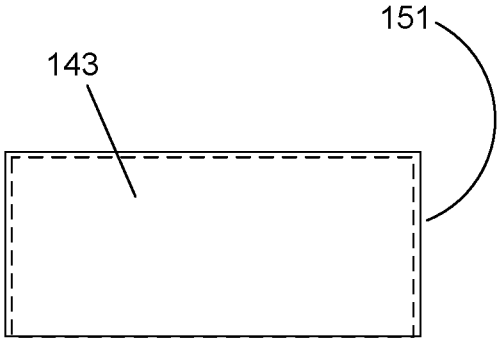

FIG. 18 shows preferred strainer 143. Strainer 143 includes multiple holes 145 to allow the flow of fluid. FIG. 19 shows a side view of strainer 143. FIG. 20 shows another preferred strainer 147. Strainer 147 is identical to strainer 143 but also includes additional holes 145 on its side to permit fluid flow. In a preferred embodiment fabric sock 151 is placed over strainer 143 to further strain smaller particles but still allow fluid flow.

In a preferred embodiment strainer 143 is placed over the drain to help prevent the flow of particulate matter into the drain. For example, FIG. 22 shows strainer 143 positioned over drain 5. In FIG. 23 the strainer 143 has been attached to the bottom of sink 2 so that it is secured over drain 5. As shown in FIG. 23, strainer 143 is preferably at a height equal to the height of elevated pump section 20. This helps ensure that debris and scum that collect at a level below elevated pump section 20 are kept away from holes 145 on top of strainer 143.

Other Preferred Embodiments

FIGS. 14-16 show other preferred embodiments of the present invention. In FIG. 14, sink 2 drains on the side rather than at the bottom as shown above in the earlier preferred embodiments. As shown in FIG. 14, drain hole 63 is on the side of sink 2. In FIG. 15 valve 65 has been threaded onto sink 2 over hole 63. During operation of sink 2, valve 65 is closed so that all contents are kept inside sink 2. At the end of operations valve 65 is opened so that the contaminated water will flow through the valve. A hose may be attached to the end of valve 65 or valve 65 may empty into a bucket or other container for proper disposal.

FIG. 16 shows another preferred embodiment of the present invention. Construction sink system 100 includes sink 2 as discussed above. However, sink 2 does not utilize a drain hole to drain sink 2 after usage. Instead a worker of construction sink system 100 will manually utilize separate water pump to pump-out the contaminated water from sink 2 after sink 2 has been utilized. The contaminated water will then be disposed of in an appropriate fashion.

Also, as shown in FIG. 17, rubberized nonslip feet 104 have been pressed onto the bottoms of drip pan 4. Feet 104 help improve traction and stability of construction sink 1.

Other Features, Modifications and Embodiments

It should be noted that in a preferred embodiment drip pan 4 can also be used during transport as a lid to cover the top of sink 2. Also, it should be noted that the utilization of drip pan 4 is not necessary. In another preferred embodiment legs 3 support sink 2 without the addition of drip pan 4.

Furthermore, it should be noted that the components of the present invention (including sink 2, screen 13 and legs 3) can be fabricated from a variety of materials. For example, in one preferred embodiment legs 3 are aluminum, screen 13 is ABS plastic and sink 2 is also ABS plastic. In another preferred embodiment legs 3 are also fabricated from ABS plastic. Other materials for part fabrication also include both galvanized and stainless steel.

Also, it should be noted that pump 20 can be powered through a variety of methods. It could be powered through normal house AC power. Power can be supplied via a portable electrical generator, including a fuel burning generator or a solar powered generator. Power may also be supplied via a battery.

While the present invention has been described in terms of preferred embodiments, the reader should consider these described embodiments only as particular embodiments. Many other embodiments are possible. Therefore, the reader should determine the scope of the present invention by the claims and their legal equivalents.

What is claimed is:

1. A construction site tool cleaning sink system, comprising:

A. a construction sink, comprising a sink bottom, a sink top and sink sides,

B. a plurality of support legs connected to said construction sink and supporting said construction sink, C. construction sink stabilizers connected to said support legs and supporting said construction sink, D. a construction sink tool support screen, covering said sink top, E. an elevated pump section integrally formed inside said construction sink, said elevated pump section comprising a support surface, wherein said support surface of said elevated pump section is at a level higher than said sink bottom, F. a water pump comprising a water pump bottom surface, wherein said water pump is positioned on top of said elevated pump section support surface so that said water pump bottom surface is at a level higher than said sink bottom, G. a filter screen and filter positioned on top of said elevated pump section support surface, so that said filter screen and said filter are at a level higher than said sink bottom, wherein said filter screen and said filter are detached from said water pump and surround said water pump, H. a flexible hose connected to said water pump, and I. a nozzle connected to said flexible hose.

2. The construction site tool cleaning sink system as in claim 1, further comprising a predrilled hole in said sink bottom and a drain valve covering said predrilled hole.

3. The construction site tool cleaning sink system as in claim 1, further comprising a drip pan positioned under said support legs and said construction sink and connected to said support legs.

4. The construction site tool cleaning sink system as in claim 1, further comprising a predrilled hole in one of said sink sides and a drain valve covering said predrilled hole.

5. The construction site tool cleaning sink system as in claim 4, further comprising a strainer positioned over said drain valve, wherein said strainer is positioned so that said strainer and said elevated pump section are at an equal height.

6. The construction site sink as in claim 5, wherein further comprising a fabric sock covering said strainer.

7. The construction site tool cleaning sink system as in claim 1, further comprising a drainage system, said drainage system comprising:

A. a predrilled hole in said sink bottom,

B. a flange positioned over said predrilled hole, said flange comprising a contoured track and a flange opening, C. c. an elbow positioned under the predrilled hole and connected to said flange, wherein said elbow comprises:

i. a ball bearing connected to said elbow and inserted into said contoured track, ii. a removable drain plug connected to said elbow and plugging said flange opening when said drainage system is in a closed position, and unplugging said flange opening when said drainage system is in an open position, wherein said drainage system is moved from said closed position to said open position by turning said elbow causing said ball bearing to move along said contoured track causing said drain plug to alternatingly plug and then unplug said flange opening.

8. The construction site tool cleaning sink system as in claim 1, wherein said construction sink tool support screen extends partially across said sink top.

9. The construction site tool cleaning sink system as in claim 1, wherein said construction sink tool support screen extends fully across said sink top.

* * * * *